US005865989A

United States Patent [19]

Cooper et al.

[11] Patent Number: 5,865,989

[45] Date of Patent: Feb. 2, 1999

[54] PROCESS FOR SWEETENING LIQUID HYDROCARBONS

[75] Inventors: John Clifton Cooper, Beaumont; Marc Daniel McConnell, Groves; Adam Richard Pawloski, Arlington, all of Tex.

[73] Assignee: Star Enterprise, Houston, Tex.

[21] Appl. No.: 531,327

[22] Filed: Sep. 20, 1995

[51] Int. Cl.[6] ..... C10G 19/02

[52] U.S. Cl. ..... 208/203; 208/226; 208/228; 208/229; 208/230

[58] Field of Search ..... 208/203, 206, 208/226, 228, 229, 230

[56] References Cited

U.S. PATENT DOCUMENTS

| | | | |
|---|---|---|---|
| 2,793,171 | 5/1957 | Keller | 208/206 |
| 4,490,246 | 12/1984 | Verachtert | 208/203 |
| 4,626,341 | 12/1986 | Verachtert | 208/235 |
| 5,244,643 | 9/1993 | Verachtert | 208/206 |

FOREIGN PATENT DOCUMENTS

| | | | |
|---|---|---|---|
| 161551 | 4/1953 | Australia | 208/203 |

*Primary Examiner*—Walter D. Griffin
*Attorney, Agent, or Firm*—Wendy K. Buskop; Chamberlain, Hrdlicka et al.

[57] ABSTRACT

A process for sweetening high mercaptan content gasoline or other liquid hydrocarbons is disclosed which utilizes aqueous caustic solution. A recycle stream is used to increase the conversion potential by reducing the relative mercaptan concentration of the untreated gasoline. Part of the treated gasoline effluent is recycled to the untreated feed. The treated gasoline has a low mercaptan concentration while the untreated gasoline is high in mercaptans. As the two streams combine, the feed to the unit becomes less concentrated in mercaptan compounds. In effect, the mercaptan concentration of the untreated gasoline has been diluted by the treated gasoline. Nitrogen inhibits the solubility of oxygen into gasoline. Nitrogen present in the recycle stream would create a system high in nitrogen and low in oxygen. By increasing the level of nitrogen, oxygen is limited in its ability to complete the sweetening reaction. In order to keep nitrogen from inhibiting oxygen, the gasoline effluent is sent to a low pressure separation vessel. in this vessel, nitrogen gas separates from the liquid gasoline. Part of this liquid gasoline stream is recycled to join with the untreated gasoline. The recycle gasoline is now free of nitrogen that would inhibit the solubility of oxygen.

16 Claims, 1 Drawing Sheet

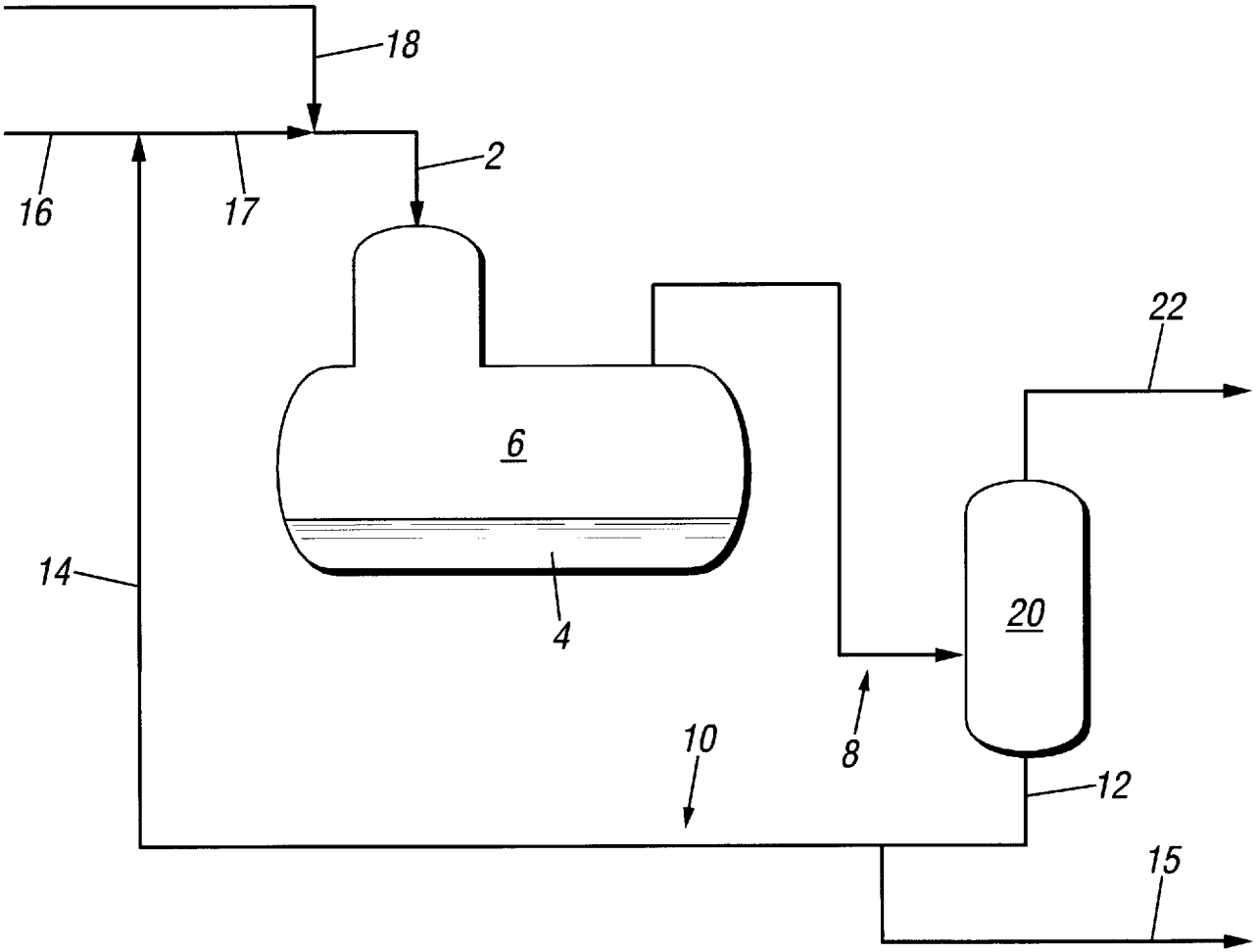
22
20
12
15
8
10
6
4
2
18
17
16
14

PROCESS FOR SWEETENING LIQUID HYDROCARBONS

BACKGROUND OF THE INVENTION

The invention relates to hydrocarbon processing. In one aspect, the invention relates to a process for converting mercaptans found in hydrocarbon streams into disulfides.

Mercaptans are undesirable in hydrocarbon products because of odor and discoloration. The effects of these compounds can be eliminated by reacting two mercaptans to form one disulfide compound, or in effect, connecting the two terminal end sulfur atoms. The reaction is usually the final stage in gasoline refining. Industly follows many methods for this process, usually involving several steps and vessels. Due to the low cost of operation, caustic treating is the preferred process.

During caustic treating, gasoline is injected with air and allowed to come into contact with a caustic solution. The caustic can contain a catalyst which promotes the chemical reaction. The reaction is based on the principles of mass diffusion, or the movement of molecules from one substance into another. The molecules of oxygen, caustic, and mercaptans must all come into contact with each other to react. The mercaptan molecules are dispersed throughout the gasoline, and thus, must travel through the gasoline until it reaches contact with the caustic and oxygen.

As the reaction takes place, oxygen is consumed. The amount of required oxygen greatly increases as the concentration of mercaptan in the gasoline increases. At a given temperature and pressure, air has a constant solubility in gasoline, therefore, regardless of the concentration of mercaptans, the concentration of oxygen is constant. When the soluble oxygen has been consumed, the reaction stops short of treating all the mercaptans. In the prior art, the problem of limited oxygen solubility was partially compensated for by increasing system pressure.

A process for treating hydrocarbon liquids which contain high concentrations of mercaptans would be desirable. A process for treating hydrocarbon liquids which contain high concentrations of mercaptans in existing low pressure equipment would be even more desirable.

OBJECTS OF THE INVENTION

It is an object of this invention to provide a process for treating hydrocarbons such as gasoline to convert mercaptans into disulfides.

It is another object of this invention to provide a process for treating hydrocarbons for the conversion of contained mercaptans into disulfides which is flexible enough to treat hydrocarbons containing any concentration of mercaptan.

It is a further object of this invention to provide a process for treating high mercaptan content hydrocarbons such as gasoline which can be easily implemented in existing plants and in existing low pressure equipment.

SUMMARY OF THE INVENTION

In accordance with the invention, an aerated liquid hydrocarbon feed stream comprising mercaptans and hydrocarbons is contacted with a liquid aqueous caustic solution in a reaction vessel under conditions to convert the mercaptans to disulfides. The resulting effluent stream, which comprises disulfides and hydrocarbons is withdrawn from the reaction vessel. A portion of the effluent stream is degassed and recycled to the reaction vessel. The process is highly useful for treating mercaptans in gasoline.

This new recycle system effectively lowers the concentration of mercaptan in the gasoline to be treated. Part of the gasoline effluent is recycled and joined with the untreated feed. As the two streams combine, the concentration of mercaptans becomes the weighted average of the two streams. The combined gasoline streams are then injected with air and allowed to contact the caustic solution. The oxygen soluble in the gasoline is now able to react with a lower concentration of mercaptans. As a result, the reaction produces a gasoline meeting odor and appearance quality.

As oxygen in consumed in the reaction, nitrogen from the air remains unaffected. Nitrogen inhibits the ability for oxygen to become soluble in gasoline. The gasoline leaving the process is saturated with nitrogen gas. Nitrogen allowed to recycle with the gasoline would inhibit oxygen solubility, thus, hindering the reaction. In a particularly preferred embodiment of the invention, a portion of the dissolved nitrogen is removed from the effluent stream to form a degassed liquid product stream. A first portion of this degassed liquid product stream is introduced into the reaction vessel.

Nitrogen should be removed from the recycle gasoline to maintain good oxygen solubility in the feed gasoline. The gasoline effluent is preferably sent to a low pressure separation vessel. Under reduced pressure, gases separate from liquids. As gasoline enters the separation vessel. nitrogen is flashed out of the gasoline. Part of this nitrogen free gasoline is recycled and mixed with the incoming untreated gasoline. When the two streams mix, they are injected with air and treated through the caustic solution. Now, the constant volume of air soluble in the gasoline is able to react with mercaptans more efficiently without nitrogen inhibition.

The preferred embodiment of the invention uses reduced pressure to remove any nitrogen which has become soluble in the gasoline effluent. When part of this flashed stream is recycled through the unit, the reaction proceeds to a further extent than was previously possible. Without this low pressure separation the system would become oxygen deficient would suffer a lower reaction conversion. This new process becomes dramatically important since more refineries today are beginning to utilize high sulfur crudes. This process can complete a reaction at very high concentrations of mercaptans, and produce a product meeting standards for sale without additional refining. This process provides a cost effective solution to rising problems in the industry.

BRIEF DESCRIPTION OF THE DRAWING

The drawing is a simplified flow diagram of a preferred embodiment of the invention.

DETAILED DESCRIPTION OF THE PREFERRED EMBODIMENTS

In accordance with one embodiment of the invention, an aerated liquid feed stream 2 is contact with a liquid aqueous caustic solution 4 in a reaction vessel 6. An effluent stream 8 is withdrawn from the reaction vessel. A portion 10 of the effluent stream introduced into the reaction vessel 6.

The aerated liquid feed stream 2 comprises mercaptans and hydrocarbons. The effluent stream 8 comprises disulfides and hydrocarbons. The reaction vessel 6 is maintained under conditions to effect the conversion of the mercaptans to disulfides.

The effluent stream 8 generally further comprises dissolved nitrogen. In a preferred embodiment of the invention, a portion of the dissolved nitrogen is removed from the effluent stream 8 to form a degassed liquid product stream 12. A first portion of the degassed liquid product stream forms the portion of the effluent stream which is introduced into the reaction vessel.

The first portion of the degassed liquid product stream contains disulfides. The first portion forms a stream 14. Preferably, the stream 14 is mixed with a sour hydrocarbon stream 16 to form a blended stream 17. The blended stream 17 is introduced into the reaction vessel into the reaction vessel 6, preferably after being admixed for aeration with air from an air stream 18.

The blended stream 17 can be formed from any liquid hydrocarbon which contains reactable amounts of mercaptans under the conditions found in the vessel 4. Preferably, the blended stream 17 is formed from refinery hydrocarbon stocks. More preferably, a major portion of the blended stream comprises hydrocarbons boiling in the range of C3 through 650 degrees F. Even more preferably, a major portion of the blended stream 17 comprises hydrocarbons boiling in the range of C5 through 430 degrees F., such as gasoline.

The invention can be used to treat or sweeten any level of mercaptan in the sour hydrocarbon stream, only the recycle rate would change. The higher the mercaptan, the higher the recycle rate. The sour hydrocarbon stream will often exhibit a mercaptan content of over 1000 ppm in the invention. The invention has special applicability to streams containing previously untreatably high mercaptan concentrations under the conditions found in conventional caustic treaters. For example, sour hydrocarbon streams containing mercaptan contents in the range of 1000 to 10,000 ppm or higher can be effectively treated in accordance with the invention, by adjusting the volume of the recycle stream. The invention has been tested with good results on sour hydrocarbon streams having a mercaptan content in the range of 2,000 to 6,000 ppm.

From a functional point of view, a sufficient amount of the stream 14 should be mixed with the stream 16 to cause the stream 12 to exhibit the desired specification for mercaptan content. For gasoline, a typical specification for mercaptan content is 20 ppm, and the invention has been tested to produce such a stream with good results. Expressed in another way, good results can be obtained where a sufficient amount of the recycle stream is mixed with the sour stream to cause the blended stream to contain mercaptan content of less than 1,000 ppm, because such streams are treatable in known caustic systems Many types of sweetening processes are known, and it is believed that the invention will be generally applicable to all of them, particularly those which rely on caustic. In one known process, the aqueous caustic solution comprises a 1 to 25 wt. % sodium hydroxide solution. It is also known to introduce many types of a mercaptan oxidation catalysts into the reaction vessel, such as cobalt catalysts in small amounts. These variations are within the scope of the present invention.

The reaction vessel 6 will generally be maintained at an elevated pressure, because elevated pressures enhance oxygen solubility. A pressure in the range of from about 20 to about 120 psig is suitable and believed to be commonly employed, although higher or lower pressures could be used if desired. Pumps can be used in the lines 16 and 14 to bring the streams to these pressures.

It is preferred to remove the nitrogen from the from the effluent stream by flashing, since flashing is a highly effective means for removing dissolved gases. Any pressure which is lower than the pressure in the reaction vessel 6 can be used. However, a low pressure such as a pressure in the range of about 0 to about 20 psig, and even more preferably in the range of from about 0 to about 5 psig is preferred, since nitrogen removal is enhanced by such low pressure flashing.

In a particularly preferred embodiment of the invention, the flashing is conducted in a separator vessel 20. The effluent stream 8 is introduced into the separator vessel. An overhead vapor stream 22 containing the removed nitrogen is withdrawn from an upper portion of the separator vessel 22. The degassed liquid product stream 12 is withdrawn from a lower portion of the separator vessel 22. The degassed liquid product stream 12 is divided into the first portion 14 and a second portion 15 which is conveyed to a storage facility. The overhead vapor stream 22 is condensed to form a dry vapor stream which may be conveyed to a fuel gas facility.

While certain preferred embodiments of the invention have been described herein. the invention is not to be construed as so limited, except to the extent such limitations are found in the claims.

We claim:

1. A continuous process for treating hydrocarbon liquids which contain high concentrations of mercaptans, said process comprising contacting an aerated liquid feed stream comprising mercaptans and liquid hydrocarbons with a liquid aqueous caustic solution in a reaction vessel;

withdrawing an effluent stream comprising disulfides and liquid hydrocarbons from the reaction vessel, wherein the effluent stream further comprises dissolved nitrogen;

removing a portion of the dissolved nitrogen from the effluent stream to form a degassed liquid hydrocarbon product stream; and introducing a first portion of the degassed liquid hydrocarbon product stream into the reaction vessel.

2. A continuous process for treating hydrocarbon liquids which contain high concentrations of mercaptans, said process comprising contacting an aerated liquid feed stream comprising mercaptans and liquid hydrocarbons with a liquid aqueous caustic solution in a reaction vessel;

withdrawing an effluent stream comprising disulfides and liquid hydrocarbons from the reaction vessel, wherein the effluent stream further comprises dissolved nitrogen;

removing a portion of the dissolved nitrogen from the effluent stream to form a degassed liquid hydrocarbon product stream; and introducing a first portion of the degassed liquid hydrocarbon product stream into the reaction vessel;

wherein the first portion of the degassed liquid hydrocarbon product stream contains disulfides, said process further comprising mixing the first portion of the degassed liquid hydrocarbon product stream with a sour liquid hydrocarbon feed stream comprising hydrocarbons and mercaptans to form a blended liquid hydrocarbon stream comprising mercaptans, aerating the blended liquid hydrocarbon stream to form the aerated liquid feed stream comprising mercaptans and liquid hydrocarbons, and introducing the aerated liquid hydrocarbon stream into the reaction vessel.

3. A process as in claim 2 wherein a major portion of the blended liquid hydrocarbon stream comprises liquid hydrocarbons boiling in the range of C5 through 430 degrees F.

4. A process as in claim 2 wherein the sour liquid hydrocarbon stream comprises a mercaptan content of over 1000 ppm.

5. A process as in claim 2 wherein the first portion of the degassed liquid product stream is mixed with the sour liquid hydrocarbon stream in a sufficient amount to provide the degassed liquid product stream with a mercaptan content of less than about 20 ppm.

6. A process as in claim 2 wherein the blended liquid hydrocarbon stream comprises a mercaptan content of less than 1,000 ppm.

7. A process as in claim 6 further comprising introducing a mercaptan oxidation catalyst into the reaction vessel.

8. A process as in claim 2 wherein the aqueous caustic solution comprises a 1 to 25 wt % sodium hydroxide solution.

9. A process as in claim 2 wherein the portion of the dissolved nitrogen is removed from the effluent stream by flashing.

10. A process as in claim 9 wherein the blended liquid hydrocarbon stream is under a pressure in the range of about 20 to about 120 psig.

11. A process as in claim 10 wherein the flashing is conducted at a pressure in the range of from about 0 to about 20 psig.

12. A process as in claim 10 wherein the flashing is conducted at a pressure in the range of from 0 to 5 psig.

13. A process as in claim 9 wherein the flashing is conducted in a separator vessel, said process further comprising introducing the effluent stream into the separator vessel;

withdrawing an overhead vapor stream from an upper portion of the separator vessel; and withdrawing the degassed liquid product stream from a lower portion of the separator vessel.

14. A process as in claim 13 further comprising dividing the degassed liquid product stream into the first portion and a second portion, and conveying the second portion of the degassed liquid product stream to a storage facility.

15. A process as in claim 13 further comprising condensing condensible components from the overhead vapor stream to form a dry vapor stream, and conveying the dry vapor stream to a fuel gas facility.

16. A continuous process for treating hydrocarbon liquids which contain high concentrations of mercaptans, said process comprising contacting a feed stream consisting essentially of an aerated liquid comprising mercaptans, liquid hydrocarbons and disulfides with a liquid aqueous caustic solution in a reaction vessel;

withdrawing an effluent stream comprising disulfides and liquid hydrocarbons from the reaction vessel, wherein the effluent stream further comprises dissolved nitrogen;

removing a portion of the dissolved nitrogen from the effluent stream to form a degassed liquid hydrocarbon product stream; and introducing a first portion of the degassed liquid hydrocarbon product stream into the reaction vessel;

wherein the first portion of the degassed liquid hydrocarbon product stream contains disulfides, said process further comprising mixing the first portion of the degassed liquid hydrocarbon product stream with a sour liquid hydrocarbon stream comprising hydrocarbons and mercaptans to form a blended liquid hydrocarbon stream;

aerating the blended liquid hydrocarbon stream to form the feed stream; and introducing the feed stream into the reaction vessel;

wherein a major portion of the feed stream comprises liquid hydrocarbons boiling in the range of C3 through 650 degrees F.

* * * * *